US006197381B1

(12) United States Patent
Saito et al.

(10) Patent No.: US 6,197,381 B1
(45) Date of Patent: Mar. 6, 2001

(54) PRODUCTION METHOD OF A RECORDING SHEET

(75) Inventors: Yoichi Saito; Masaru Tsuchiya; Masaaki Okazaki, all of Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/299,381

(22) Filed: Apr. 27, 1999

(30) Foreign Application Priority Data

Apr. 30, 1998 (JP) ..... 10-137508

(51) Int. Cl.[7] ..... B05D 3/02

(52) U.S. Cl. ..... 427/374.3; 427/378; 427/393.5; 427/412.1

(58) Field of Search ..... 427/374.1, 374.2, 427/374.3, 378, 393.5, 412.1

(56) References Cited

U.S. PATENT DOCUMENTS 4,460,637 * 7/1984 Miyamoto et al. .

FOREIGN PATENT DOCUMENTS

218956 * 4/1987 (EP) .
56-000157 * 1/1981 (JP) .
7-076106 * 3/1995 (JP) .
9-087560 * 3/1997 (JP) .

* cited by examiner

*Primary Examiner*—Erma Cameron
(74) *Attorney, Agent, or Firm*—Jordan B. Bierman; Bierman, Muserlian and Lucas

(57) ABSTRACT

A production method of a recording sheet characterized in that a void layer having a dry thickness of 25 to 60 $\mu$m is formed by coating, onto at least one surface of a support, a void layer-forming coating composition comprising fine inorganic particles having an average particle diameter of not more than 100 nm and a hydrophilic binder, as well as not more than 10 coarse particles per ml having a particle diameter greater the particle diameter R (in $\mu$m) represented by formula (1) described below.

$$R=80000/L^2 \qquad \text{Formula (1)}$$

wherein L represents the total dry layer thickness (in $\mu$m) of said void layer.

26 Claims, No Drawings

PRODUCTION METHOD OF A RECORDING SHEET

FIELD OF THE INVENTION

The present invention relates to a production method of a recording sheet having a void layer on a support, and specifically to a production method of a recording sheet in which cracking on the surface of the coated layer is minimized.

BACKGROUND OF THE INVENTION

Ink-jet recording is carried out in such a manner that fine droplets of ink are allowed to fly employing various operation principles and are adhered onto a recording sheet such as a sheet of paper to record images and characters. Ink-jet recording exhibits advantages such as relatively high speed, low noise, ease of multicolor production, and the like. Conventional problems of this system regarding clogging of nozzles and maintenance have been solved by improving both aspects of ink and the device, and at present, ink-jet recording has been rapidly applied to a variety of fields such as various printers, facsimile machines, computer terminals, and the like.

Requirements for a recording sheet employed in such ink-jet recording system is that the density of printing dots is high; color tone is bright and clear; ink is rapidly absorbed and when printing dots are superimposed, ink should neither run out nor blot; the diffusion of a printing dot in the lateral direction should not be greater than that needed and the circumference should be smooth and result in no blurring; and the like.

Particularly, at low rates of ink absorption, when recording is carried out by superimposing at least two color inks, on a recording sheet, droplets result in repellence to cause unevenness and in the boundary area of different colors, mutual colors result in blurring. As a result, image quality tends to be markedly degraded. Therefore, it is required that the recording sheet exhibits high ink absorbability.

In order to solve these problems, conventionally, a great number of techniques have been proposed.

For example, Japanese Patent Publication Open to Public Inspection No. 52-53012 describes a recording sheet in which minimally sized paper support is damped with paint employed for surface treatment; Japanese Patent Publication Open to Public Inspection No. 55-5830 describes a recording sheet comprising a support in which an ink absorbing coating layer is provided on the surface of the support; Japanese Patent Publication Open to Public Inspection No. 56-157 describes a recording sheet comprising a covering layer containing non-colloidal silica powder as a pigment; Japanese Patent Publication Open to Public Inspection No. 57-107873 describes a recording sheet comprising an inorganic pigment and an organic pigment in combination; Japanese Patent Publication Open to Public Inspection No. 58-110287 describes a recording sheet which exhibits a void distribution with two peaks; Japanese Patent Publication Open to Public Inspection No. 62-111782 describes a recording sheet composed of an upper porous layer and a lower porous layer; Japanese Patent Publication Open to Public Inspection Nos. 59-68292, 59-123696, 60-18383, etc. describe a recording sheet having amorphous cracking; Japanese Patent Publication Open to Public Inspection Nos. 61-135786, 61-148092, 62-149475, etc. describe a recording sheet having a fine powder layer; Japanese Patent Publication Open to Public Inspection Nos. 63-252779, 1-108083, 2-136279, 3-65376, 3-27976, etc. describe a recording sheet comprising pigments and fine silica particles having specified physical parameters; Japanese Patent Publication Open to Public Inspection Nos. 57-14091, 60-219083, 60-210984, 61-20797, 61-188183, 5-278324, 6-92011, 6-183134, 7-137431, 7-276789, etc. describe a recording sheet containing fine silica particles such as colloidal silica; Japanese Patent Publication Open to Public Inspection Nos. 2-276671, 3-67684, 3-215082, 3-251488, 4-67986, 4-263983, 5-16517, etc. describe a recording sheet containing fine hydrated alumina particles, and the like.

Of these, a recording sheet provided with a void layer composed of fine organic particles having an average diameter of not more than 100 nm and a hydrophilic binder as an ink absorbing layer is preferred, which employs a technique for achieving high ink absorbability and glossiness at the same time.

Further, with such a void layer, a large content of fine inorganic particles with respect to a hydrophilic binder is needed for the formation of voids, and the resulting void layer becomes rigid due to markedly high rigidity. Such a rigid layer is required to obtain high ink absorbability. However, it has been found that during the coating and drying processes of the void layer, cracking readily occurs in the presence of tiny foreign matter, due to low flexibility of the layer and problems are caused in a case of the dry void layer having a thickness of not less than 25 $\mu$m, which is specifically required for ink-jet recording.

It has been found that when a recording sheet having such a void layer is produced, relatively coarse particles such as coarse inorganic particles themselves, coagulum of fine inorganic particles, coagulum of other additives tend to be formed due to various causes during preparing the coating composition, and these coarse particles cause cracking during coating and drying onto a support.

SUMMARY OF THE INVENTION

In view of the foregoing, the present invention has been accomplished. An object of the present invention is to provide a production method of a recording sheet, in which cracking of the coated layer surface due to coarse particles is markedly minimized when a recording paper having a void layer with high gloss is produced. Another object is to provide a production method of the recording sheet, which lowers the production cost, and results in a high void ratio, water resistance and glossiness.

DETAILED DESCRIPTION OF THE INVENTION

The problems of the present invention are solved by each of the following:

1. A production method of a recording sheet which comprises:

coating onto at least one surface of a support with a coating solution so as to form a void layer having a dry thickness of 25 to 60 $\mu$m, wherein said coating solution comprising;

fine inorganic particles having an average particle diameter of not more than 100 nm, a hydrophilic binder, and not more than 10 coarse particles, per 1 (ml) of said coating solution, having a particle diameter of more than R ($\mu$m) represented by formula (1):

$$R=80000/L^2 \qquad \text{Formula (1)}$$

wherein L represents said dry thickness ($\mu$m) of said void layer.

2. The production method of item 1, wherein said coating solution further comprises a hydrophobic latex having a glass transition temperature of not more than 30° C. and an average particle diameter of not more than 100 μm, or an emulsion dispersion of hydrophobic organic compound particles having a melting point of not more than 30° C.

3. The production method of item 1, further comprising: filtering said coating solution through a filter which can filter out particles having a diameter of said R (μm) or more.

4. The production method of item 1, wherein said support is a non-water absorbing support.

5. The production method of item 1, further comprising: cooling said coating solution on the support to not more than 15° C., and drying said coating solution on the support with air blow at a temperature of 20 to 60° C.

6. A production method of a recording sheet which comprises:

coating onto at least one surface of a support with a first coating solution so as to form a first void layer nearest the support;

coating onto said support with at least one coating solution, so as to form void layers having a dry thickness of 25 to 60 μm including the first void layer, which comprises fine inorganic particles having an average particle diameter of not more than 100 nm and a hydrophilic binder;

wherein the first coating solution comprising fine inorganic particles having an average particle diameter of not more than 100 nm, a hydrophilic binder, and not more than 5 coarse particles, per 1 (ml) of said coating solution, having a particle diameter of more than R (μm) represented by formula (2):

$$R=80000/L^2 \qquad \text{Formula (2)}$$

wherein L represents said dry thickness (μm) of said void layers.

7. The production method of item 6, coating solutions including the first coating solution are coated at the same time substantially.

The present invention will be detailed below.

Employed as the fine inorganic particles used in the present invention, can be those in a wide range. For example, in addition to silica, calcium carbonate, titanium oxide, zinc oxide, alumina, barium sulfate, magnesium carbonate, calcium silicate, etc., various natural or synthetic fine inorganic particles can also be employed.

Fine inorganic particles may be either individual fine inorganic particles or fine inorganic particles of which surfaces are covered with various organic compounds such as, for example, a cationic polymer.

When the recording sheet is an ink-jet recording sheet, silica or alumina, due to its low refractive index, is preferably employed to form an ink receptive layer for the ink-jet recording sheet, for which transparency is relatively required.

As the silica, preferably employed are colloidal silica, cation-modified colloidal silica, silica synthesized employing a gas phase method, etc. Of these, fine silica particles synthesized employing a gas phase method and fine cationic composite particles of which surface is covered with a cationic polymer are preferred because a high void ratio is readily obtained.

Various average diameters of fine inorganic particles can be employed. However, when fine inorganic particles having an average diameter of not more than 100 nm are employed, the effect of the present invention can be obtained.

When fine inorganic particles having a diameter exceeding 100 nm are employed, it becomes difficult to obtain high glossiness.

There is no particular lower limit of the average diameter of fine organic particles, however, the average diameter of fine inorganic particles is preferably at least 5 nm, and is most preferably in the range of 5 to 80 nm.

Preferred as fine inorganic particles forming the ink receptive layer of the ink-jet recording sheet, is a gas phase method silica in which the average diameter of the primary particles is preferably not more than 100 nm, and is more preferably not more than 30 nm.

The average particle diameter as described herein is obtained as a diameter which is obtained by observing the particles employing an electron microscope, measuring its projection area and converting the area to a circle having the same area.

As hydrophilic binders employed in the void layer, various types of conventional hydrophilic binders known in the art are employed. However, preferably employed hydrophilic binders are different depending on the anionic or cationic property of the fine inorganic particles.

When the surface of the fine inorganic particles is anionic, nonionic binders or anionic binders are employed in combination of one of each or more, and when the surface of inorganic particles is cationic, nonionic binders or cationic binders are employed in combination of one of each or more.

Listed as examples of the nonionic binders are, for example, gelatin, polyvinyl alcohol, polyethylene oxide, polyacrylamide, polyvinyl pyrrolidone, hydroxyethyl cellulose, dextran, etc.

Listed as anionic hydrophilic binders are hydrophilic polymers having an anionic group such as a carboxyl group, a sulfo group, etc., for example, polyacrylic acid, carboxymethyl cellulose, agar, carageenan, dextran sulfate salt, etc.

Listed as cationic hydrophilic binders are those which are prepared by modifying water-soluble nonionic polymers to cationic polymers such as cation-modified polyvinyl alcohol or cation-modified polyvinyl pyrrolidone, or water-soluble polymers having a quaternary ammonium salt group, etc.

The ratio of fine inorganic particles to the above-mentioned hydrophilic binder is generally in the range of 2 to 10 in terms of weight ratio.

In the above-mentioned void layer-forming coating composition, coarse particles tend to be formed due to various causes during the production process. As the causes, coarse particles are formed due to coarse particles contained in raw materials and these particles are relatively readily removed during the production process. Those which particularly cause problems are coarse foreign matter newly formed during preparing a coating composition.

Coarse foreign matters formed during preparing the coating composition are roughly divided into two; one is a coagulum formed by shock or physical stress during mixing a hydrophilic binder with fine inorganic particle dispersion or other additives, and the other is dried foreign matter formed on the coated surface.

The former is frequently formed by locally generated variations of the surface charge of fine inorganic particles when the fine inorganic particles come into contact with the solvent of additives or localized variations of salt concentration during mixing the additives.

On the other hand, the latter dried foreign matter formed on the surface of the coating composition is generally gradually dissolved with stirring. However, the higher the water resistance of the void layer becomes, the more the solubility tends to decrease.

When the above-mentioned coarse foreign substance is contained and coated as it is, after drying, it causes cracking in the rigid void layer and this cracking largely depends on the total dry layer thickness. When the same coating composition was coated while simply changing the layer thickness, it was found that cracking increased markedly as the total dry layer thickness increased.

Accordingly, when it is specifically necessary to provide a relatively thick void layer, it is particularly required to manage the content of coarse grains in the coating composition. From such a view point, diligent investigation has been carried out, and as a result, the present invention has been accomplished.

Namely, in the case of a total dry layer thickness of not more than 20 μm, even when a coating composition comprising coarse particles having a diameter of at least 100 μm is coated, the foreign matter itself remains in the layer. As a result, a matte-like surface may be formed on the layer. However, because cracking is rarely caused due to the foreign matter working as a nucleus, print quality is not markedly degraded.

On the other hand, when the total dry layer thickness exceeds 50 μm, coarse particles, having a diameter of not less than about 30 μm, greatly contribute to the formation of cracking, and when foreign matter having a diameter of not less than that is not decreased as much as possible, cracking is caused over the entire surface. Cracks of about 0.1 to about 2 mm are generally formed, though it is dependent on the size of the foreign matter. When ink-jet recording is carried out in this area, no recording results which markedly degrades print quality.

In the present invention, the manageable diameter of coarse foreign matter in a coating composition is varied in accordance with the resulting dry layer thickness. As a result, an excellent coating surface with minimum cracking can be realized, and this variation can be applied to cases in which a void layer having a total dry thickness of 25 to 60 μm is formed.

In the case of a total dry layer thickness of less than 25 μm, as described above, there occurs almost no practical problem caused by cracking due to coarse particles. Furthermore, when used as an ink-jet recording sheet, it is not commercially viable due to low ink absorption.

On the other hand, in cases of a total dry layer thickness of not less than 60 μm, cracking is caused due to extremely fine particles. In practice, it becomes very difficult to control such fine particles.

In the present invention, the number of coarse particles having a diameter of not less than R μm represented by formula (1) is required to be not more than 10 per ml of the coating composition, is preferably to be no more than 5, and is most preferably to be no more than 3.

The recording sheet of the present invention is applied to a recording sheet comprising a support onto which at least one void layer is coated.

In the case of a single void layer, as described above, the number of coarse particles having a diameter of not less than R μm represented by formula (1) is preferably adjusted to be no more than 10 per ml of the coating composition, forming the void layer.

When void layers are composed of two layers or more, it is necessary that the diameter of coarse particles in the void layer nearest the support should be adjusted so as to be less. The number of coarse particles having a diameter of not less than R μm represented by (1) is no more than 5 per ml of the coating composition which forms a void layer nearest the support. The particularly preferred number is no more than 2.

The above-mentioned coarse particle can be readily measured employing a commercially available particle measurement apparatus, for example, based on a laser beam scattering principle.

In order to adjust the number of coarse particles having a size specified by the present invention of the coating composition to form a void layer to between 5 to 10, it is required that, naturally, prior to preparing a coating composition, undissolved foreign matter and undispersed foreign matter which are contained in raw materials are to be previously removed, and any addition solution is to be diluted or addition is performed slowly so that the liquid surface does not dry during the preparation process of the coating composition or during mixing, no physical stress is induced on the composition.

Other than these, in order to remove foreign matter, which is inevitably formed in a coating composition, after preparing the coating composition, it is preferred to filter out, employing a filter, particles having a diameter greater than that which relates to cracking, as defined in the present invention.

One such filter can be employed, or two or more thereof may be employed in series. Further, various types of filters which can filter out particles of different diameters can be employed in series.

The recording sheet of the present invention has high gloss and a high void ratio. In order to decrease cracking, the above-mentioned hydrophilic binder is preferably hardened, employing a hardener.

Hardeners are generally compounds having a group which can react with the above-mentioned hydrophilic binder or compounds which promotes reaction between different groups of the hydrophilic binder. Suitable selection is carried out in accordance with the types of hydrophilic binders.

Listed as specific examples of such hardeners are, for example, epoxy series hardeners (diglycidyl ethyl ether, ethylene glycol diglycidyl ether, 1,4-butanediol diglycidyl ether, 1,6-diglycidylcyclohexane, N,N-diglycidyl-4-glycidyloxyaniline, sorbitol polyglycidyl ether, glycerol polyglycidyl ether, etc.), aldehyde series hardeners (formaldehyde, glyoxal, etc.), active halogen series hardeners (2,4-dichloro-4-hydroxy-1,3,5-s-triazine, etc.), active vinyl series compounds (1,3,5-torisacryroyl-hexahydro-s-triazine, bisvinylsulfonyl methyl ether, etc.), boric acid and salts thereof, borax, aluminum alum, etc.

When, as particularly preferred hydrophilic binders, polyvinyl alcohol and/or cation-modified polyvinyl alcohol is employed, hardeners selected from boric acids and salts thereof, and epoxy series hardeners are preferably employed.

The most preferred hardeners are those selected from boric acids and salts thereof.

In the present invention, boric acids and salts thereof include oxygen acids having a boron atom as a central atom and salts thereof, specifically, orthoboric acid, diboric acid, metaboric acid, tetraboric acid, pentaboric acid, octaboric acid and salts thereof.

The employed amount of the above-mentioned hardener varies depending on the types of binders, the types of hardeners, the types of fine inorganic particles, the ratio to the hydrophilic binder, etc.; is generally between 5 and 500 mg per g of the hydrophilic binder, and is preferably between 10 and 300 mg.

The above-mentioned hardener, when a coating composition to form a void layer is coated, may be added into the coating composition to form the void layer or a coating composition to form other layers adjacent to the void layer.

Or, onto a support on which a coating composition comprising a hardener has been coated, the above-mentioned void layer-forming coating composition is coated, and further, after a void layer forming hardener-free coating composition is coated and dried, a hardener can be supplied to the void layer by coating a hardener-containing coating composition onto the resulting layer. However, in terms of production efficiency, a hardener is added into a void layer-forming coating composition or a coating composition to form a layer adjacent to the void layer is added and the hardener is preferably supplied at the same time when the void layer is formed.

In the particularly preferred embodiment, in which a void layer is composed of ultra-fine silica particles and polyvinyl alcohol, a hardener is previously added into a void layer-forming coating composition and the resulting composition is left for a specified period (preferably at least 10 minutes, most preferably at least 30 minutes). When such coating composition is coated onto a support and subsequently dried, a high void ratio can be achieved without degrading layer brittleness.

Furthermore, in order to minimize cracking, the recording sheet of the present invention preferably comprises a hydrophobic latex having a glass transition temperature of not more than 30° C., or oil droplets prepared by emulsify-dispersing a hydrophobic organic compound having a melting point of not more than 30° C.

The hydrophobic latex having a glass transition temperature of not more than 30° C. is a polymer latex which is prepared employing an emulsion polymerization method. For example, preferably employed are styrene-butadiene copolymer latex, polyacrylic acid ester series latex, polymethacrylic acid ester latex, vinyl acetate series latex, ethylene-vinyl acetate series latex, silicone series latex, etc.

Examples of the above-mentioned polymer latex include, for example, polyvinyl acetate latex, vinyl acetate/ethylene latex (9/1), vinyl acetate/ethyl methacrylate latex (5/5), vinyl acetate/n-butyl acrylate (5/5), vinyl acetate/butyl acrylate latex (4/6), butyl acrylate latex, ethyl acrylate/butyl methacrylate/styrene (40/55/5), ethyl acrylate/butyl acrylate/HEMA (3/6/1), styrene/butyl acrylate/HEMA (15/80/5), silicone latex, etc. Figures in parenthesis express a mole ratio of the copolymer, while HEMA represents hydroxyethyl methacrylate.

Used, as the above-mentioned hydrophobic compounds which form oil droplets, are organic compounds having a melting point of not more than 30° C., commonly called a hydrophobic high boiling point organic solvent.

Listed as such hydrophobic organic compounds can be, for example, phthalic acid esters (dibutyl phthalate, di-2-ethylhexyl phthalate, di-isodecyl phthalate, etc.), phosphoric acid esters (for example, tricresyl phosphate, trioctyl phosphate, etc.), fatty acid esters (butyl stearate, bis(2-ethylhexyl) sebatate, ethylene glycol stearate, etc.), amides (N,N-diethyllaurylamide, N,N-diethyl-2-(2,5-di-t-amylphenoxybutaneamide), etc.), ethers (ethylene glycol dibutyl ether, decyl ether, etc.), silicone oil, liquid paraffin, hydrophobic polymers such as poly-2-ethylhexyl methacrylate, poly-n-butyl methacrylamide, etc.

The above-mentioned hydrophobic compound is emulsified and dispersed into a hydrophilic binder, preferably in the presence of a surface active agent, employing a high speed rotation homogenizer, a high pressure homogenizer, etc., and employed. In such cases, emulsification dispersion is preferably carried out in the presence of low boiling point organic solvents such as ethyl acetate, propyl acetate, etc., to obtain tiny droplets.

At the time, can be employed other hydrophobic compounds (for example, UV absorbers, antioxidants, fluorescent whitening agents, oil-soluble dyes for adjusting a white background), and the employed amount is preferably not more than 50 percent by weight of the hydrophobic organic compound having a melting point of not more than 30° C., which is employed to form the oil droplets.

The average particle diameter of the above-mentioned hydrophobic latex and emulsified and dispersed oil droplets is not more than 5 $\mu$m; is preferably no more than 1 $\mu$m, and is more preferably between 0.05 and 0.5 $\mu$m.

Furthermore the added amount is between 0.1 and 20 weight percent of all the inorganic particles, and is preferably between 0.2 and 10 weight percent. All the added layers may be void layers or other additional layers.

Various types of additives, other than those described above, may be incorporated into the void layers and the other layers provided as required.

Incorporated can be, for example, various types of cationic polymers, various types of cationic or nonionic surface active agents, UV absorbers described in Japanese Patent Publication Open to Public Inspection Nos. 57-74193, 57-87988, and 62-261476, anti-discoloring agents described in Japanese Patent Publication Open to Public Inspection Nos. 57-74192, 58-87989, 60-72785, 61-146591, 1-95091, and 3-13376, fluorescent whitening agents described in Japanese Patent Publication Open to Public Inspection Nos. 59-42993, 59-52689, 62-280069, 61-242871, and 4-219266, and various types of additives known in the art such as pH regulators, for example, sulfuric acid, phosphoric acid, citric acid, sodium hydroxide, potassium carbonate, etc., anti-foaming agents, antiseptics, thickeners, antistatic agents, matting agents, etc.

The void volume of the recording sheet of the present invention is between about 20 and about 50 ml/m$^2$, and the void ratio of such a void layer is between about 0.5 and 0.8.

Conventionally, employed mainly as the supports of the recording sheet of the present invention are suitably paper supports, plastic supports, and composite supports known in the art. However, in order to obtain sharp and clear images with increased density, hydrophilic supports, into which solvents such as water, etc. cannot penetrate, are preferably employed. Hydrophobic supports include, for example, transparent or opaque plastic supports, supports obtained by covering a paper surface with a plastic resin, etc.

Transparent supports include, for example, film composed of materials such as polyester series resins, diacetate series resins, triacetate series resins, acrylic series resins, polycarbonate series resins, polyvinyl chloride series resins, poyimide series resins, cellophane, celluloid, etc. Of these, those are preferred, which are resistant to heat, when used for OHP, of which polyethylene terephthalate is particularly preferred. The thickness of such a transparent support is preferably between about 10 and about 200 $\mu$m. It is preferred to provide a subbing layer known in the art onto the ink receptive layer side as well as the reverse side of a transparent support from the view point of adhesion of the ink receptive layer and the backing layer with the support.

Furthermore, as supports which do not require transparency, preferably employed are, for example, resin coated paper (so-called RC paper) which has, on at least one surface of the paper base, a polyolefin resin coated layer into which a white pigment, etc. are added, and so-called white PET prepared by incorporating a white pigment into polyethylene terephthalate.

With the purpose of increasing the adhesion strength of the above-mentioned support with the ink receptive layer, prior to coating the ink receptive layer, corona discharging and subbing are preferably applied to a support. Furthermore, the recording sheet of the present invention is not always required to be white, and colored recording sheets may also be employed.

As the ink-jet recording sheet of the present invention, a paper support which is laminated with polyethylene on both surfaces is particularly preferred because recorded images approach photographic qualities and are obtained at relatively low cost. Such a polyethylene laminated paper support is described below.

Paper employed for a support is produced employing wood pulp as a main raw material, and in addition, synthetic pulp such as polypropylene, etc. or synthetic fiber such as nylon, polyester, etc., if required. As the wood pulp, any of LBKP, LBSP, NBKP, NBSP, LDP, NDP, LUKP, and NUKP can be employed. However, LBKP, NBSP, LBSP, NDP, and LDP, having a shorter fiber portion, are preferably employed in a larger ratio. However, the content ratio of LBSP and/or LDP is preferably between 10 and 70 weight percent.

As the above-mentioned pulp, chemical pulp (sulfate salt pulp or sulfite pulp) containing minimum impurities is preferably employed, and pulp which is subjected to bleaching treatment to increase whiteness is also beneficial.

Into the paper, can appropriately be added higher fatty acids, sizing agents such as alkylketene dimer, etc., white pigments such as calcium carbonate, talc, titanium oxide, etc., paper strengthening agents such as starch, polyacrylamide, polyvinyl alcohol, etc., fluorescent whitening agents, moisture maintaining agents such as polyethylene glycol, etc., dispersing agents, softening agents such as quaternary ammonium, etc.

The degree of water freeness of pulp employed for paper-making is preferably between 200 and 500 ml in accordance with CSF specification. Furthermore, the sum of the weight percent of 24-mesh residue and the weight percent of 42-mesh calculated portion regarding the fiber length after beating, specified in JIS-P-8207, is preferably between 30 and 70 percent. Further, the weight percent of 4-mesh residue is preferably not more than 20 weight percent.

The weight of the paper is preferably between 30 and 250 $g/m^2$, and is most preferably between 50 and 200 $g/m^2$, while the thickness of the paper is preferably between 40 and 250 $\mu$m.

The paper is calendered, during or after paper-making process, to result in enhanced smoothness. The density of the paper is generally between 0.7 and 1.2 $g/m^2$ (JIS-p-8118) Furthermore, the rigidity of the paper is preferably between 20 and 200 g under conditions specified in JIS-P-8143.

A surface sizing agent may be coated onto the surface of the paper. As surface sizing agents, those described above, which can be incorporated into the paper, can also be employed.

The pH of the paper, when measured employing a hot water extraction method, specified in JIS-P-8113, is preferably between 5 and 9.

As polyethylene which covers both surfaces of the paper base, low density polyethylene (LDPE) and/or high density polyethylene (HDPE) is mainly employed. However, other than these, LLDPE, polypropylene, etc. can be partially employed.

Specifically, a polyethylene layer on the surface of an ink receptive layer is preferably one in which, as carried out in photographic paper, rutile- or anatase-type titanium oxide is incorporated into polyethylene, and opacity as well as whiteness are improved. The content of titanium oxide is generally between 3 and 20 percent by weight of polyethylene, and is preferably between 4 and 13 percent by weight.

Polyethylene coated paper can be employed as glossy paper. Furthermore, in the present invention, polyethylene coated paper having a matte or silk surface can also be employed, which is prepared by embossing when the polyethylene is melt-extrude-coated onto the surface of the paper.

The employed amount of polyethylene on both surfaces of the paper is determined so that after providing an ink receptive layer and a backing layer, the tendency to curl is minimized under low and high humidity. Generally, the thickness of the polyethylene layer on the ink receptive layer side is in the range of 20 to 40 $\mu$m, and that of the backing layer side is in the range of 10 to 30 $\mu$m.

Furthermore, a polyethylene coated paper support having the following characteristics is preferably employed:

(1) tensile strength: being the strength specified in JIS-P-8113, 2 to 30 kg in the longitudinal direction, and 1 to 20 kg in the lateral direction (2) tear strength: to be 10 to 200 g in the longitudinal direction and 20 to 200 g in the lateral direction in accordance with the method specified in JIS-P-8116

(3) compression elastic modulus: 103 $Kgf/cm^2$ or more (4) Beck surface smoothness: preferably not less than 20-second light for a gloss surface under conditions specified in JIS-P-811, and for embossed paper support, acceptable for less than this value (5) opacity: visible light transmittance of not more than 20 percent, and most preferably not more than 15 percent, under measuring conditions of parallel light incidence/diffused light transmission.

With the recording sheet of the present invention, various types of hydrophilic layers such as a void layer, a subbing layer, etc., which are optionally employed, if required, are coated onto a support employing a method suitably selected from those known in the art. A preferred method is such that a coating composition composing each layer is coated and dried. In this case, at least two layers can be simultaneously coated. Specifically, simultaneous coating is preferred, which simultaneously coats all hydrophilic binder layers.

Employed as the coating method are preferably a roll coating method, a rod bar coating method, an air knife coating method, a spray coating method, a curtain coating method, or an extrusion coating method employing a hopper, as described in U.S. Pat. No. 2,681,294.

After a coating composition, to form a void layer, is coated onto a support, the resulting coated layer is generally dried with forced heated air. However, in the present invention, drying is preferably carried out in such a manner that after coating, the resulting coated layer is temporarily cooled to not more than 15° C. and is then rapidly dried with blown air at a temperature of 20 to 60° C. because unevenness of the layer surface and cracking tend not to occur.

When directly blowing warm or hot air, the viscosity of the coating composition is excessively reduced and liquid unevenness tends to be localized due to blown air, and in portions where liquid becomes thicker, cracking is marked.

During coating, generally, a coating composition maintained at a temperature of 30 to 50° C. is coated. In this case, the viscosity is between 5 and 100 cp. With an increase in the viscosity of the coating composition cooled to not more than 15° C., the unevenness of the coating composition is prevented, which also minimize s cracking .

After being temporarily cooled, when warm or hot air is blown, the layer temperature is not so increased due to vaporization latent heat of water to minimize the unevenness of the coating composition.

After cooling, drying is carried out while blowing air at a temperature of 20 to 60° C. preferably for 2 to 5 minutes. In order to minimize cracking, the drying air is preferably filtered, employing a filter having a suitable size to remove as much foreign matter as possible. In the present invention, "coating solutions including the first coating solution are coated at the same time substantially" means that a next solution is coated on the first coating solution coated on a support before the first coated layer is not dried.

When the recording sheet of the present invention is employed for ink-jet printing, in the case of recording images employing an ink-jet recording sheet, a recording method using water-based ink is preferably employed.

The water-based ink as described herein is a recording liquid comprised of colorants described below, composition media, and other additives. Employed as colorants can be water-soluble dyes and water-dispersible pigments, known in the art regarding materials for ink-jet printing such as direct dyes, acid dyes, basic dyes, reactive dyes, or food dyes, etc.

Listed as solvents of water-based inks are water and various water-soluble organic solvents, for example, alcohols such as methyl alcohol, isopropyl alcohol, n-butyl alcohol, tert-butyl alcohol, isobutyl alcohol, etc.; amides such as dimethylformamide, dimethylacetamide, etc.; ketones or ketone alcohols such as acetone, diacetone alcohol, etc.; ethers such as tetrahydrofran, dioxane, etc.; polyalkylene glycols such as polyethylene glycol, polypropylene glycol, etc.; polyhydric alcohols such as ethylene glycol, propylene glycol, butylene glycol, triethylene glycol, 1,2,6-hexanetriol, thioglycol, hexylene glycol, diethylene glycol, glycerin, triethanolamine, etc.; lower alkyl ethers of polyhydric alcohols such as ethylene glycol methyl ether, diethylene glycol methyl (or ethyl) ether, triethylene glycol monobutyl ether, etc.; etc.

Of a number of these water-soluble organic solvents, polyhydric alcohols such as diethylene glycol, triethanolamine, glycerin, etc., and lower alkyl ethers of polyhydric alcohols such as triethylene glycol monobutyl ether, etc., are preferred.

Other additives for the water-based inks include, for example, pH regulators, sequestering agents, mildewcides, viscosity modifiers, surface tension adjusting agents, wetting agents, surface active agents, rust preventives, etc.

In order to improve wettability onto a recording sheet, the water-based ink solution preferably has, at 20° C., a surface tension in the range of 25 to 60 dyn/cm, and preferably in the range of 30 to 50 dyn/cm.

EXAMPLES

The present invention will be described with reference to examples. However, the present invention is not limited to these examples. Further, "%" in the examples refers to bone-dry percent by weight, unless otherwise specified.

Example 1

Added to 100 liters of an aqueous solution C1 (having a pH of 2.5, and containing 2 g of antifoaming agent SN381, manufactured by San Nobuko Co.) containing 12 weight percent of cationic polymer P-1, 5 weight percent of n-propanol, and 2 weight percent of ethanol, was 450 liters of a 20 percent aqueous solution A1 (having a pH of 2.5, and containing 1 weight percent ethanol) of gas phase method silica (A200, manufactured by Nihon Aerojiru Kogyo Co.) with an average diameter of 0.012 μm, composed, in advance, of uniformly dispersed primary particles, while stirring at room temperature.

Next, 4 liters of a 5 percent aqueous boric acid solution was slowly added while stirring.

The resulting mixture was then dispersed at a pressure of 500 kg/cm$^2$ employing a high pressure homogenizer, manufactured by Sanwa Kogyo Co., and uniform and almost transparent dispersion B1 was obtained.

The resulting dispersion was filtered employing a TCP-30 type filter manufactured by Advantex Toyo Co., having a filtering accuracy of 30 μm.

Subsequently, a coating composition (CS1 ) was prepared by mixing the above-mentioned dispersion B1 successively with additives as described below (50 liters of a composition was prepared and the following values represent figures per liter of the coating composition).

| | |
|---|---|
| Silica dispersion B1 | 620 ml |
| Polyvinyl alcohol (PVA 203, manufactured by Kuraray Co.) 10% aqueous solution | 5 ml |
| Polyvinyl alcohol (PVA 235, manufactured by Kuraray Co.) 5% aqueous solution | 265 ml |
| Silicone dispersion (BY-22-839, manufactured by Toray ΣDow CorningΣ Silicone Co.) | 30 ml |
| Hydrophobic latex having an average particle diameter of no more than 100 μm (Boncoat SFC-55 with Tg of 0° C., manufactured by Dainippon Ink Kagaku Kogyo Inc.) | 20 ml |
| Deionized water to make | 1000 ml |

Furthermore, coating composition CS2 was prepared in the same manner as CS1, except that the silicone dispersion was removed from the above-mentioned additives. Coating composition CS3 was prepared in the same manner as CS2, except that the hydrophobic latex was further removed from the coating composition CS2.

Furthermore, coating composition CS4 was prepared in the same manner as CS2, except that 20 ml of the hydrophobic latex in the coating composition CS2 were replaced with 20 ml of a liquid paraffin dispersion prepared as described below.

Preparation of the liquid paraffin dispersion: mixed with 60 ml water containing 1.8 g of acid-processed gelatin and 1.1 g of saponin was a solution prepared by dissolving 10 g of liquid paraffin in 15 ml of ethyl acetate; the resulting mixture was dispersed, and the total volume of the dispersion was then adjusted to 90 ml using water.

Each of the obtained coating compositions was filtered employing a TCW type filter manufactured by Advantex Toyo Co. (using 3 types of mesh diameters as shown in Table 1), and a coating composition, for a single layer ink-jet recording sheet, was obtained.

The obtained coating composition was diluted five times employing deionized water. The number of particles having a diameter of at least 19 μm, at least 32 μm, at least 65 μm, and at least 200 μm was measured employing a Haiakku/Roiko Intelligent Particle Counter 8000A manufactured by Nozaki Sangyo Co. Table 1 shows the number of particles per ml.

P-1

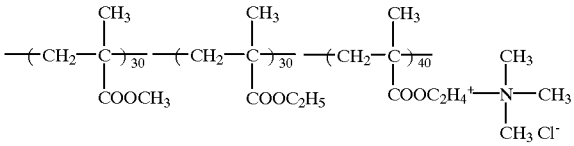

TABLE 1

| Particle Diameter | No Filtration (a) | Mesh Diameter 75 μm (b) | Mesh Diameter 50 μm (c) | Mesh Diameter 25 μm (d) |
|---|---|---|---|---|
| Coating Composition CS1 | | | | |
| 19 μm | 2800 | 2300 | 1900 | 521 |
| 32 μm | 815 | 512 | 302 | 82 |
| 65 μm | 34 | 12 | 3 | 0 |
| 200 μm | 4 | 1 | 0 | 0 |
| Coating Composition CS2 | | | | |
| 19 μm | 3200 | 2700 | 2200 | 827 |
| 32 μm | 1050 | 520 | 334 | 76 |
| 65 μm | 35 | 13 | 2 | 0 |
| 200 μm | 5 | 0 | 0 | 0 |
| Coating Composition CS3 | | | | |
| 19 μm | 2900 | 2400 | 2000 | 505 |
| 32 μm | 850 | 530 | 300 | 80 |
| 65 μm | 35 | 13 | 2 | 0 |
| 200 μm | 5 | 1 | 0 | 0 |
| Coating Composition CS4 | | | | |
| 19 μm | 3100 | 2700 | 2200 | 795 |
| 32 μm | 1000 | 550 | 320 | 82 |
| 65 μm | 36 | 12 | 2 | 0 |
| 200 μm | 4 | 0 | 0 | 0 |

| | | |
|---|---|---|
| CS1: | addition of latex | addition of silicone |
| CS2: | addition of latex | no addition of silicone |
| CS3: | no addition of latex | no addition of silicone |
| CS4: | addition of hydrophobic organic compound particles having a melting point of no more than 30° C. | no addition of silicone |

Next, a 240 μm thick support, described below, was coated with each coating solution while varying the wet-thickness so as to obtain a dry-thickness of 20 μm, 35 μm, 50 μm, and 65 μm.

Support: a paper support prepared by laminating polyethylene onto both surfaces of paper having a weight of 170 g/m$^2$ The approximately 35 μm thick polyethylene layer comprising 9 weight percent of anatase-type titanium oxide on the recording side of the paper, and the reverse side of the paper base was laminated with a polyethylene layer having a thickness of about 30 μm.

Onto both surfaces of the polyethylene layers, 0.1 g/m$^2$ gelatin was coated as a subbing layer.

The glossiness of the surface of the recording layer was 32% at 75 degrees and the glossiness of the reverse surface was 23%.

A coating composition was coated at 40° C. employing a slide hopper, and immediately after coating, was chilled for 20 seconds in a chilling zone maintained at 0° C. to lower the temperature of the coated layer to not more than 10° C. Thereafter, the chilled layer was successively dried for 60 seconds with 20 to 30° C. air, for 60 seconds with 45° C. air, and for 60 seconds with 50° C. air.

The cracking state on obtained samples was visually observed and was also observed employing a magnifying lens, by which the number of cracks per 0.3 m$^2$ on the surface of the coated layer was determined. Table 2 shows the results.

At each dry layer thickness, the particle diameters relating to cracking obtained according to the formula (1) of the present invention are as follows:

| Dry Layer Thickness | Particle Diameter (R) |
|---|---|
| 20 μm | 200 μm |
| 35 μm | 65 μm |
| 50 μm | 32 μm |
| 65 μm | 19 μm |

TABLE 2

| Particle Diameter | No Filtration (a) | Mesh Diameter 75 μm (b) | Mesh Diameter 50 μm (c) | Mesh Diameter 25 μm (d) |
|---|---|---|---|---|
| Coating Composition CS1 | | | | |
| 20 μm | 2 | 0 | 0 | 0 |
| 35 μm | 31 | 15 | 1 | 0 |
| 50 μm | >100 | >100 | >100 | >100 |
| 65 μm | >100 | >100 | >100 | >100 |
| Coating Composition CS2 | | | | |
| 20 μm | 0 | 0 | 0 | 0 |
| 35 μm | 22 | 11 | 0 | 0 |
| 50 μm | >100 | >100 | >100 | >100 |
| 65 μm | >100 | >100 | >100 | >100 |
| Coating Composition CS3 | | | | |
| 20 μm | 1 | 0 | 0 | 0 |
| 35 μm | 30 | 13 | 1 | 0 |
| 50 μm | >100 | >100 | >100 | >100 |
| 65 μm | >100 | >100 | >100 | >100 |
| Coating Composition CS4 | | | | |
| 20 μm | 0 | 0 | 0 | 0 |
| 35 μm | 26 | 13 | 0 | 0 |
| 50 μm | >100 | >100 | >100 | >100 |
| 65 μm | >100 | >100 | >100 | >100 |

When the number of cracks is approximately 10 or less per 0.5 m$^2$, practically no major problems occur.

Based on the results in Tables 1 and 2, it is found that when coating is carried out so as to obtain a dry layer thickness of 35 μm (in the range of the present invention), coating compositions (CS1 (c) and (d), and CS2 (c) and (d)), which are filtered employing a 50 μm or 25 μm filter, comprise, per ml, no more than 10 particles of R≧65 μm, and an excellent layer is obtained.

Further, when employing coating compositions (CS1 (a) and (b), and CS2 (a) and (b)) comprising at least 11 particles of R≧65 μm per ml, no less than 11 cracks per 0.5 m$^2$ are caused on each coated layer.

Furthermore, when coating is carried out so as to obtain a dry layer thickness 50 μm and 65 μm, with either coating compositions CS1 or CS2, the number of particles of each of R≧32 μm and R≧19 μm is no less than 10 per ml. Thus, the number of cracks markedly increases as like at least 11.

When the coating composition CS4 is employed, which comprises the hydrophobic organic compound particles according to the present invention, the number of cracks is less than the coating composition CS3 which does not comprise the same. Furthermore, when employing the coating composition CS3 comprising the hydrophobic latex according to the present invention, cracking decreases further and a markedly excellent layer tends to be obtained.

Example 2

Coating compositions CS2 ((b), (c), and (d)) employed in Example 1 were used and the same evaluation as in Example 1 was carried out employing compositions ((b)í, (c)í, and (d) í) which were filtered two times, employing a 25 μm filter for the filtered composition in Example 1.

Table 3 shows the number of particles in the coating compositions.

TABLE 3

| Particle diameter | Coating Composition CS2 Mesh Diameter 75 μm (b)' | Mesh Diameter 50 μm (c)' | Mesh Diameter 25 μm (d)' |
|---|---|---|---|
| 10 μm or more | 5100 | 4700 | 3400 |
| 19 μm or more | 310 | 210 | 56 |
| 32 μm or more | 18 | 9 | 2 |
| 40 μm or more | 2 | 0 | 0 |
| 50 μm or more | 0 | 0 | 0 |
| 65 μm or more | 0 | 0 | 0 |
| 80 μm or more | 0 | 0 | 0 |
| 200 μm or more | 0 | 0 | 0 |

A recording sheet was obtained by coating a composition onto a support in the same manner as Example 1. The layer surface of the recording sheet was inspected, and the obtained results are shown in Table 4.

TABLE 4

| Dry Layer Thickness | Coating Composition CS2 Mesh Diameter 75 μm (b)' | Mesh Diameter 50 μm (c)' | Mesh Diameter 25 μm (d)' |
|---|---|---|---|
| 20 μm or more | 0 | 0 | 0 |
| 35 μm or more | 0 | 0 | 0 |
| 50 μm or more | 13 | 6 | 0 |
| 65 μm or more | >100 | >100 | 87 |

From the results in Tables 3 and 4, it is found that when coating is carried out so as to obtain a dry layer thickness of 35 μm in the range of the present invention, the number of particles of R≧65 μm is within 10 (or none)/ml when employing any coating composition, and thus, no cracking occurs on the layer surface.

When coating is carried out so as to obtain a dry layer thickness of 50 μm in the range of the present invention, in coating compositions CS2 (c)' and (d)', the number of particles of R≧32 μm is no more than 10 per ml. Thus, the layer surface results in less cracks and is excellent.

Further, when the coating composition CS2 (b)' is employed, the number of particles of R≧32 μm exceeds 10 per ml. Thus, the number of cracks increases markedly.

Example 3

Dispersion B2 was prepared in the same manner as Example 1, except that in the silica dispersion Bi prepared in Example 1, the silica is replaced with a 1:1 mixture of silica A300 and A200 prepared employing a gas phase method, manufactured by Nihon Aerojiru Co., in which the average diameter of primary particles is 0.007 μm.

In order to prepare a multilayer system ink-jet recording sheet, four types of coating compositions below were prepared.

Preparation of First Layer Coating Composition (in volume per liter of the coating composition)

| | |
|---|---|
| Silica dispersion B2 | 650 ml |
| Fluorescent whitening agent dispersion (described below) | 30 ml |
| Polyvinyl alcohol (PVA 203, manufactured by Kuraray Co.) 10% agueous solution | 5 ml |
| Polyvinyl alcohol (PVA 235, manufactured by Kuraray Co.) 5% agueous solution | 270 ml |
| Hydrophobic latex having an average particle diameter of no more than 100 μm (Boncoat SFC-55 with Tg of 0° C., manufactured by DainipponInk Kagaku Kogyo Inc.) | 20 ml |
| Deionized water to make | 1000 ml |

Second Layer Coating Composition (in volume per liter of the coating composition)

| | |
|---|---|
| Silica dispersion B2 | 650 ml |
| Fluorescent whitening agent dispersion (described below) | 30 ml |
| Polyvinyl alcohol (PVA 203, manufactured by Kuraray Co.) 10% aqueous solution | 5 ml |
| Polyvinyl alcohol (PVA 235, manufactured by Kuraray Co.) 5% aqueous solution | 270 ml |
| Hydrophobic latex having an average particle diameter of no more than 100 μm (Boncoat SFC-55 with Tg of 0° C., manufactured by DainipponInk Kagaku Kogyo Inc.) | 20 ml |
| Deionized water to make | 1000 ml |

Third Layer Coating Composition (in volume per liter of the coating composition)

| | |
|---|---|
| Silica dispersion B2 | 620 ml |
| Fluorescent whitening agent dispersion (described below) | 20 ml |
| Polyvinyl alcohol (PVA 203, manufactured by Kuraray Co.) 10% aqueous solution | 5 ml |
| Polyvinyl alcohol (PVA 235, manufactured by Kuraray Co.) 5% agueous solution | 270 ml |
| Hydrophobic latex having an average particle diameter of no more than 100 μm (Boncoat SFC-55 with Tg of 0° C., manufactured by DainipponInk Kagaku Kogyo Inc.) | 10 ml |
| Deionized water to make | 1000 ml |

Fourth Layer Coating Composition (in volume per liter of the coating composition)

| | |
|---|---|
| Silica dispersion B1 | 600 ml |
| Polyvinyl alcohol (PVA 203, manufactured by Kuraray Co.) 10% aqueous solution | 5 ml |
| Polyvinyl alcohol (PVA 235, manufactured by Kuraray Co.) 5% aqueous solution | 270 ml |
| Surface active agent (saponin) 5% aqueous solution | 10 ml |
| Cationic surface active agent (S-1) 5% aqueous solution | 10 ml |
| Silicone dispersion (BY-22-839, | 20 ml |

-continued

| | |
|---|---|
| manufactured by Toray ΣDow CorningΣ Silicone Co.) | |
| Deionized water to make | 1000 ml |

Fluorescent whitening agent dispersion: added into 100 ml of a 3% aqueous acid-processed gelatin solution (containing 4 g of saponin and 2 g of cationic polymer P-9) was a composition prepared by thermally dissolving 0.6 g of an oil-soluble fluorescent whitening agent (UVITEX-OB) manufactured by Ciba-Geigy Co. and 12 g of diisodecyl phthalate in 25 ml of ethyl acetate, and the resulting mixture was emulsified and dispersed employing an ultrasonic homogenizer. Water was then added to make a total volume of 140 ml.

S-1

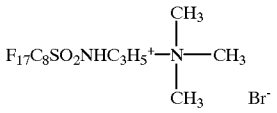

The viscosity of each of the above-mentioned coating compositions was between 30 and 40 cp at 40° C., and was between 10,000 and 20,000 cp at 15° C.

The coating compositions prepared as described above were applied to as a simultaneous four-layer coating onto the support used in Example 1, employing the same coating device, as well as the same drying conditions as Example 1 so as to obtain a total dry layer thickness of 20 μm, 35 μm, 50 μm, and 65 μm, respectively (coating was carried out so as to obtain first, second, third, and forth layers having the same dry layer thickness).

Prior to coating these coating compositions, the second, third, and fourth layer coating compositions were filtered twice using a filter having the 25 μm filter out which was employed in Example 1, and were then filtered once employing a 10 μm filter.

On the other hand, the first layer coating composition filtered as described in Table 5. The maximum number of particles in the first, second, third, and fourth layer ting compositions is shown in Table 5.

TABLE 5

| | | First Layer Coating Composition | | | |
|---|---|---|---|---|---|
| | | (e) | (f) | (g) | (h) |
| Filtering Conditions (mesh diameter) | First Time | none | 50 μm | 25 μm | 50 μm |
| | Second Time | none | 25 μm | 25 μm | 25 μm |
| | Third Time | none | 25 μm | 25 μm | 10 μm |
| Number of Coarse Particles | | | | | |
| Particle diameter | 200 μm or more | 6 | 0 | 0 | 0 |
| Particle diameter | 65 μm or more | 22 | 2 | 0 | 0 |
| Particle diameter | 32 μm or more | 1210 | 16 | 3 | 1 |
| Particle diameter | 19 μm or more | 5200 | 1300 | 920 | 140 |

TABLE 5-continued

| | | Second to Fourth Layer Coating Compositions | | |
|---|---|---|---|---|
| Number of Coarse Particles | | Second Layer | Third Layer | Fourth Layer |
| Particle diameter | 200 μm or more | 0 | 0 | 0 |
| Particle diameter | 65 μm or more | 0 | 0 | 0 |
| Particle diameter | 32 μm or more | 0 | 0 | 0 |
| Particle diameter | 19 μm or more | 82 | 59 | 32 |

The number of cracks of obtained recording sheets was determined. Table 6 shows the results.

TABLE 6

| Total Dry Layer Thickness | First Layer Coating Composition (e) | (f) | (g) | (h) |
|---|---|---|---|---|
| 20 μm | 14 | 0 | 0 | 0 |
| 35 μm | >100 | 8 | 1 | 0 |
| 50 μm | >100 | 35 | 4 | 2 |
| 65 μm | >100 | >100 | >100 | >100 |

From the results in Tables 5 and 6, it is found that when coating is carried out so as to obtain a dry layer thickness of 35 μm, which is in the range of the present invention, the number of cracks per ml of each layer prepared by employing first layer coating compositions (f), (g), and (h) comprising the number of particles of R≧65 μm of no more than 5 per ml, is preferably no more than 10.

furthermore, when coating is carried out so as to obtain a dry layer thickness of 50 μm, which is in the range of the present invention, the number of cracks of each coated layer prepared by employing first layer coating compositions (g) and (h) is preferably no more than 10.

Effects the Invention

Based on the present invention, even when a relatively layer is coated onto a support, the formation of cracking defects is minimized and a recording sheet having an excellent coated layer surface is obtained.

What is claimed is:

1. A production method of a recording sheet which comprises:

coating a coating solution onto at least one surface of a support to form a void layer having a dry thickness of 25 to 60 μm, wherein said coating solution comprises (1) fine inorganic particles having an average particle diameter of not more than 100 nm, (2) a hydrophilic binder, and (3) not more than 10 coarse particles per ml of said coating solution, said coarse particles having a particle diameter of more than R (μm) represented by Formula (1)

$$R=80000/L^2 \quad \text{Formula (1)}$$

wherein L represents said dry thickness of said void layer in μm.

2. The production method of claim 1, wherein said coating solution further comprises a hydrophobic latex having a glass transition temperature of not more than 30° C. and an average particle diameter of not more than 100 μm, or an emulsion dispersion of hydrophobic organic compound particles having a melting point of not more than 30° C.

3. The production method of claim 1, further comprising:

filtering said coating solution through a filter which can filter out particles having a diameter of said R ($\mu$m) or more.

4. The production method of claim 1, wherein said support is a non-water absorbing support.

5. The production method of claim 1, further comprising: cooling said coating solution on the support to not more than 15° C., and drying said coating solution on the support with air blown at a temperature of 20 to 60° C.

6. The production method of claim 1 wherein said inorganic particles are selected from the group consisting of silica, calcium carbonate, titanium oxide, zinc oxide, alumina, barium sulfate, magnesium carbonate, or calcium silicate.

7. The production method of claim 6 wherein said inorganic particles are silica or alumina.

8. The production method of claim 6 wherein said hydrophilic binder is a nonionic or anionic binder when a surface of said inorganic particles is anionic, or a nonionic or cationic binder when said surface of said inorganic particles is cationic.

9. The production method of claim 6 wherein said hydrophilic binder is polyvinyl alcohol or cation-modified polyvinyl alcohol.

10. The production method of claim 8 wherein said inorganic particles have an average diameter of at least 5 $\mu$m.

11. The production method of claim 10 wherein said inorganic particles are present in an amount of 2% to 10% by weight based on said hydrophilic binder.

12. The production method of claim 8 wherein a void volume of said recording sheet is from about 20 to about 50 ml/m$^2$.

13. The production method of claim 2 wherein the amount of said hydrophobic latex or said emulsion dispersion is from 0.1% to 20% by weight based on all of the inorganic particles.

14. The production method of claim 3 further comprising:

cooling said coating solution on the support to not more than 15° C., and drying said coating solution with air blown at 20° to 60° C.

15. A production method of a recording sheet which comprises:

coating a first coating solution onto at least one surface of a support to form a first void layer nearest the support;

coating at least one additional coating solution onto said support to form a plurality of void layers which include said first void layer, each of said void layers having a dry thickness of 25 to 60 $\mu$m, said void layers comprising fine inorganic particles having an average particle diameter of not more than 100 nm and a hydrophilic binder;

wherein said first coating solution comprises (1) fine inorganic particles having an average particle diameter of not more than 100 nm, (2) a hydrophilic binder, and (3) not more than 5 coarse particles per ml of said first coating solution, said coarse particles having a particle diameter of more than R ($\mu$m) represented by formula (2):

$$R=80000/L^2 \qquad \text{Formula (2)}$$

wherein L represents said dry thickness of said void layers in $\mu$m.

16. The production method of claim 15, coating solutions including the first coating solution are coated at substantially the same time.

17. The production method of claim 15 wherein said inorganic particles are selected from the group consisting of silica, calcium carbonate, titanium oxide, zinc oxide, alumina, barium sulfate, magnesium carbonate, or calcium silicate.

18. The production method of claim 17 wherein said inorganic particles are silica or alumina.

19. The production method of claim 17 wherein said hydrophilic binder is nonionic or anionic binder when a surface of inorganic particles is anionic, or nonionic or cationic binder when said surface of inorganic particles is cationic.

20. The production method of claim 19 wherein said hydrophilic binder is polyvinyl alcohol or cation-modified polyvinyl alcohol.

21. The production method of claim 20 wherein said inorganic particles have an average diameter of not less than 5 $\mu$m.

22. The production method of claim 21 wherein said inorganic particles are present in an amount of 2% to 10% by weight based on said hydrophilic binder.

23. The production method of claim 19 wherein a void volume of said recording sheet is from about 20 to about 50 ml/m$^2$.

24. The production method of claim 19 further comprising filtering said first coating solution through a filter which can filter out particles having a diameter of said R or more.

25. The production method of claim 24 further comprising cooling said first coating solution and said additional coating solutions on the support to not more than 15° C., and drying said first coating solution and said additional coating solution on support with air blown at a temperature of 20° to 60° C.

26. The production method of claim 15 wherein said additional coating solution comprise a hydrophilic binder and inorganic particles having an average particle diameter of not more than 100 nm.

* * * * *